US006322457B1

(12) United States Patent
Klein

(10) Patent No.: US 6,322,457 B1
(45) Date of Patent: Nov. 27, 2001

(54) GOLF PUTTER HEAD INCLUDING BALL RETRIEVAL DEVICE

(76) Inventor: Roger Allen Klein, 348 Greenbriar Dr., Ravenna, OH (US) 44266

( * ) Notice: Subject to any disclaimer, the term of this patent is extended or adjusted under 35 U.S.C. 154(b) by 0 days.

(21) Appl. No.: 09/532,980

(22) Filed: Mar. 22, 2000

(51) Int. Cl.[7] ..... A63B 53/04; A63B 47/02

(52) U.S. Cl. ..... 473/286; 473/340; 294/19.2

(58) Field of Search ..... 473/286, 313, 473/340, 341, 251, 219, 228, 327, 406, 407, 408, 324, 131; D21/736, 742, 752, 733; 294/19.2

(56) References Cited

U.S. PATENT DOCUMENTS

| | | | |
|---|---|---|---|
| D. 217,483 | * | 5/1970 | Jackson . |
| D. 291,908 | | 9/1987 | Glennon et al. . |
| D. 324,556 | | 3/1992 | Guerin, Sr. . |
| D. 326,302 | | 5/1992 | Guerin, Sr. . |
| 3,632,112 | | 1/1972 | Jacobs . |
| 3,944,231 | | 3/1976 | Johnson . |
| 4,248,430 | | 2/1981 | Kepler . |
| 4,361,329 | | 11/1982 | Brock . |
| 4,580,784 | | 4/1986 | Brill . |
| 4,902,015 | * | 2/1990 | Nebbia . |
| 4,934,702 | | 6/1990 | Serizawa . |
| 4,951,951 | * | 8/1990 | Meyer . |
| 4,976,436 | | 12/1990 | Serizawa . |
| 5,127,653 | | 7/1992 | Nelson . |
| 5,137,275 | | 8/1992 | Nelson . |
| 5,269,525 | | 12/1993 | Hull et al. . |
| 5,368,302 | | 11/1994 | Thomas . |
| 5,485,999 | | 1/1996 | Hull et al. . |
| 5,509,658 | | 4/1996 | Youngblood . |
| 5,601,499 | * | 2/1997 | Segaline . |
| 5,628,696 | | 5/1997 | Frye . |
| 5,692,968 | | 12/1997 | Shine . |

* cited by examiner

*Primary Examiner*—Sebastiano Passaniti
(74) *Attorney, Agent, or Firm*—Mary Ann Tucker

(57) ABSTRACT

A golf putter head with a cutout for engaging and retrieving a golf ball from the green or other surface without bending over or stooping down. The cutout extends perpendicularly through both the front face surface and the rear surface of the putter head and has an upper surface and a pair of flat, opposing walls that terminate in lower edges to form an opening for receiving a golf ball into the cutout. The cutout walls are tapered toward each other at their upper edges to form a self-holding taper for engaging the golf ball. The cutout is positioned in the heel section of the putter head so that the cutout opens vertically through the sole of the putter head, or horizontally through the heel of the putter head, or at any angle between the vertical and the horizontal.

12 Claims, 2 Drawing Sheets

GOLF PUTTER HEAD INCLUDING BALL RETRIEVAL DEVICE

BACKGROUND OF THE INVENTION

Golf is a popular sport played by people of widely varying ages and skill levels. Therefore, many devices have been developed to assist golfers and enhance their enjoyment of the sport. Among these are devices built into a golf putter head for picking up a golf ball from the surface of the putting green and/or from the cup without bending over or stooping down. The golf ball retrieving devices fall into two categories: 1) rearward facing cavities that scoop the golf ball from the green or other surface by moving the club head backward, and 2) receptacles in the sole of the club head that frictionally grip the golf ball in order to retrieve the ball from the green or from the cup. All of these putter heads have shortcomings, however.

Many commercially available putter heads of both the blade type and the mallet type fall within the first category and are constructed with rear cavities that enable a golf ball to be scooped from the green or other surface. A certain level of skill, however, is necessary for a golfer to successfully retrieve a ball using this type of devise.

The second category of prior putter heads are mallet or wide blade style putter heads that include a restricted cylindrical, conical, semi-cylindrical or semi-conical receptacle in the bottom of the putter head. Downward pressure is applied on the ball with the putter head to compress the ball around a significant portion of its diameter and squeeze it into a restricted opening. This pressure and compression may damage both the ball and the green. In addition, it is difficult to see the ball and guide it into the receptacle because the putter head covers all or a large portion of the ball. Some of the ball-retrieving devises also employ roughened surfaces or sharp edges to more securely grip the ball. These rough surfaces and sharp edges also may damage the ball.

The putter heads of the second category that are designed to retrieve a golf ball from the cup must have a length from toe to heel that will fit within the 4.25 inches diameter of the cup. In this case, the short length of the putter head makes it difficult to place the putter face in an orthogonal orientation to the desired line of travel of the ball. Placing a golf club within the cup to retrieve a ball also may cause substantial damage to the cup.

Concentration is essential when putting. A golfer looking down at the putter head when aligning a putt and making a stroke sees the putter head in just two dimensions. The popular heel and toe weighted, narrow blade type of putter head presents to the golfer a very clean, generally rectangular, non-distracting top planar profile of about 1 inch by about 5 inches. Most of the second category of prior ball-retrieving devises, however, require radical variations from this basic putter head profile and could well distract the golfer during the alignment or the stroke. The second category of putter head is seldom, if ever, available commercially.

All of the prior putter heads, whether blade type or mallet type and whether category one or category two, have the ball-retrieving receptacle positioned centrally between the toe and the heel of the putter, and behind the front striking face of the putter head.

BRIEF SUMMARY OF THE INVENTION

A golf club can be successful only if any added features do not diminish the effectiveness of the club for its primary purpose, i.e., propelling a golf ball in the desired direction for the desired distance. Therefore, an object of the present invention is to provide a golf putter head including an improved, easy to use ball-retrieving device that overcomes the shortcomings of prior devices and provides additional benefits without affecting the primary performance of the putter.

The putter head of the present invention is designed to retrieve a ball only from the green or other surface and comprises a narrow blade type head. Unlike prior putter heads, the putter head of the invention contains a golf ball-receiving cutout in the heel section that extends perpendicularly through the front face surface and the rear surface of the putter head. The cutout has an upper surface and a pair of walls formed by two opposing flat smooth surfaces that terminate in straight, parallel lower edges to form an opening for receiving a golf ball into the cutout. The opening between the lower edges is greater than the diameter of a golf ball. The cutout walls are tapered toward each other at their upper edges at an included angle between about 3 degrees and about 22 degrees to form a self-holding taper for engaging a golf ball. The cutout is positioned in the heel section of the putter head so that the cutout opens vertically through the sole of the putter head, or horizontally through the heel of the putter head, or at any angle between the vertical and the horizontal. The upper surface connects the two cutout walls to form the closed end of the cutout. The axial height of the cutout is sufficient to allow engagement of a golf ball with the cutout walls without interference from the upper surface of the cutout. When a vertical cutout opening is placed over a golf ball, the weight of the putter exerts sufficient pressure to engage the ball between a single point of contact with each cutout wall. When a golf ball is positioned between a horizontal cutout and a solid object, such as the golfer's shoe, a slight pressure on the club head toward the ball also is sufficient to engage the ball between a single point of contact with each cutout wall. Thus, the cutout of the present invention acts in a manner analogous to picking up a golf ball using just the thumb and forefinger. This device requires only minimal contact between the ball and the cutout walls, operates without requiring compression of the ball, sharp edges or roughened surfaces and, therefore, will not damage the ball.

Since the ball-retrieving cutout of the present improved putter head is contained entirely within the heel of the putter head, the top planar profile of the improved putter head mimics the generally rectangular shape of traditional heel and toe weighted blade style putters. This familiar sight is less likely to distract the golfer than the radically different profiles presented by many of the prior art golf ball-retrieving putter heads. In addition, the improved narrow blade design of the present invention has a width from the front face surface to the rear surface of the putter head that is less than the diameter of a golf ball. Therefore, the ball is easily visible from above the putter head and the cutout is easily positioned over the ball. Furthermore, the golfer does not need to position the ball in the center of the cutout in order to retrieve it. The self-holding taper of the cutout walls will engage a golf ball securely at two points on an arc on the surface of the ball that is less than the diameter of the ball.

BRIEF DESCRIPTION OF THE DRAWINGS

These and other advantages of the golf putter head of the present invention will be apparent from the following detailed description of the invention and from the drawings, in which.

DETAILED DESCRIPTION OF THE INVENTION

Figure 2:
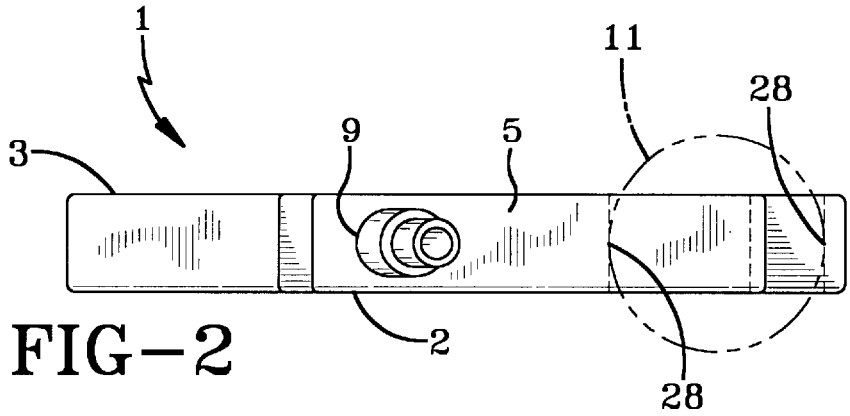
FIG. 2 is a top plan view of the embodiment of FIG. 1.
Figure 1:
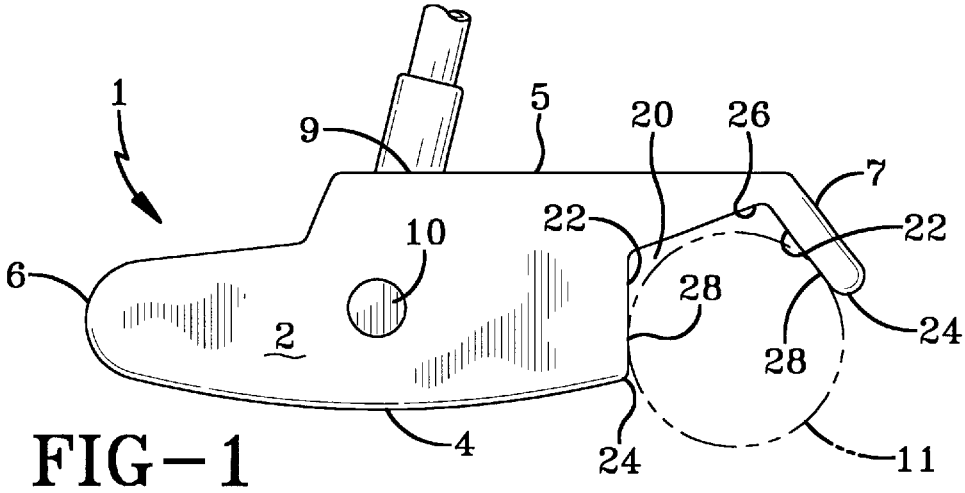
FIG. 1 is a front elevation view of one embodiment of the golf putter head.

The present invention provides a golf putter head, generally designated as 1, that incorporates an improved device for retrieving a golf ball from the putting green or other surface. FIG. 1 and FIG. 2 show an embodiment of the present invention wherein a golf ball-receiving cutout 20 is positioned in the heel section 7 of putter head 1 at an angle approximately midway between the horizontal and the vertical. As shown in FIG. 2, the putter head 1 of this invention has a front face surface 2 for striking (putting) the golf ball, a rear surface 3 that is approximately parallel to the front face surface 2, and a top surface 5 having a generally rectangular planar profile. As shown in FIG. 1, the putter head 1 also has sole surface 4, a toe section 6 fore, and a heel section 7 aft. The sole surface 4 may be flat or may be curved in a toe to heel direction. Preferably the sole surface 4 has a large radius curvature. The width of the putter head 1 between the front face surface 2 and the rear surface 3 is less than the diameter of a golf ball, preferably between about 0.5 inches and about 1.5 inches, more preferably between about 0.5 inches and about 1.25 inches, and most preferably between about 0.5 inches and about 1.0 inch.

The heel section 7 of the putter head 1 contains a golf ball receiving cutout 20 that extends perpendicularly through both the front face surface 2 and the rear surface 3, and opens to the sole surface 4 of the putter head 1. The cutout 20 has an upper surface 26 and a pair of walls 22 formed by two opposing flat smooth surfaces that terminate in straight, parallel lower edges 24 to form an opening in the sole surface 4 of the putter head 1. The lower edges 24 are spaced apart at a distance greater than the diameter of a golf ball in order to allow passage of a golf ball 11, shown by a phantom line. The cutout walls 22 are tapered toward each at their upper edges at an included angle of from about 3 degrees to about 22 degrees to form a self-holding taper. Preferably the included taper angle is from about 10 degrees to about 16 degrees, and most preferably the included taper angle is about 14 degrees. The upper surface 26 connects the two cutout walls 22 to form the closed end of the cutout 20. The axial height of the cutout 20 is sufficient to allow engagement of a golf ball with the cutout walls 22 without interference from the upper surface 26 of the cutout. The distance between lower edges 24 of the cutout 20 and the height of the cutout 20 are coordinated with the taper of the walls 22 so that the cutout 20 will accommodate the standard American golf ball, the larger magna golf ball, and the smaller British golf ball. In FIG. 1 the upper surface 26 of the cutout is in the shape of a flat plane. The upper surface 26, however, may take any suitable shape, provided that the shape of the upper surface 26 does not interfere with engaging a golf ball within the cutout 20. When the cutout opening in the sole surface 4 is placed on a golf ball 11, the weight of the putter exerts sufficient pressure to engage the ball between two points of contact 28 with the cutout walls 22. The ball 11 can then be raised to the golfer's hand and removed from the cutout 20.

Figure 3:
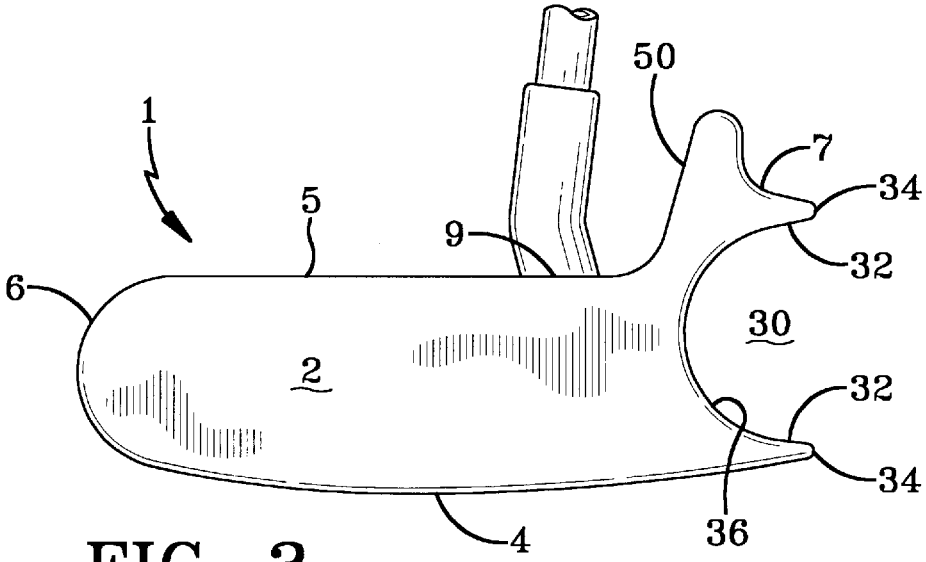
FIG. 3 is a front elevation view of a second embodiment of the golf putter head.

FIG. 3 shows a second embodiment of the present invention. In this embodiment, heel section 7 of the putter head 1 contains a golf ball-receiving cutout 30 having an upper surface 36 and a pair of walls 32. Cutout 30 is positioned so that the lower edges 34 of cutout walls 32 form an opening in the heel section 7 of the putter head 1 and the cutout opens horizontally through the heel. In the embodiment of FIG. 3, the upper surface 36 of the cutout 30 is in the shape of a partial cylinder. When a golf ball is positioned between the horizontal cutout and a solid object, such as the golfer's shoe, a slight pressure o the club head toward the ball is sufficient to engage the ball between a single point of contact with each cutout wall.

Figure 4:
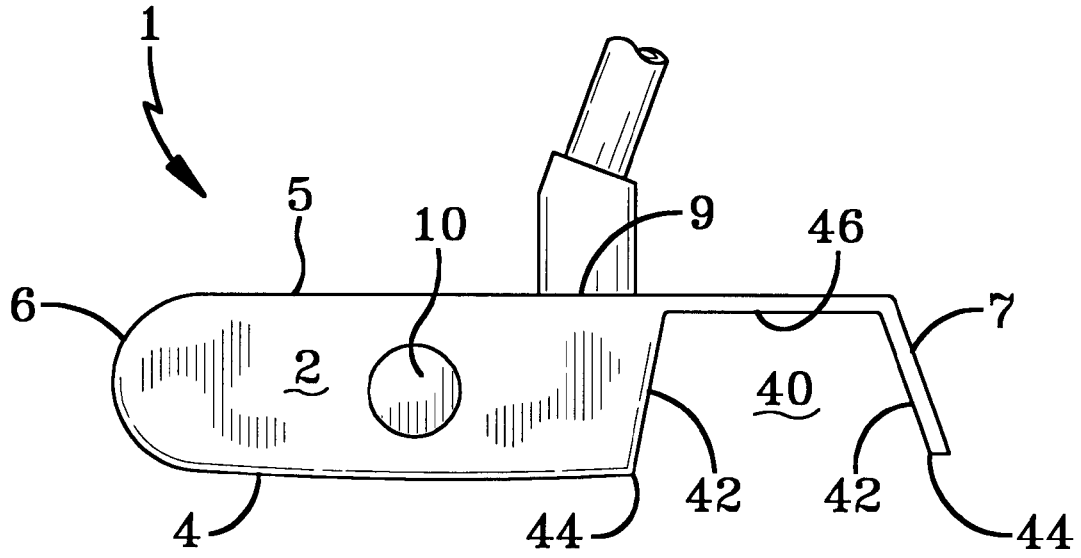
FIG. 4 is a front elevation view of a third embodiment of the golf putter head.
Figure 5:
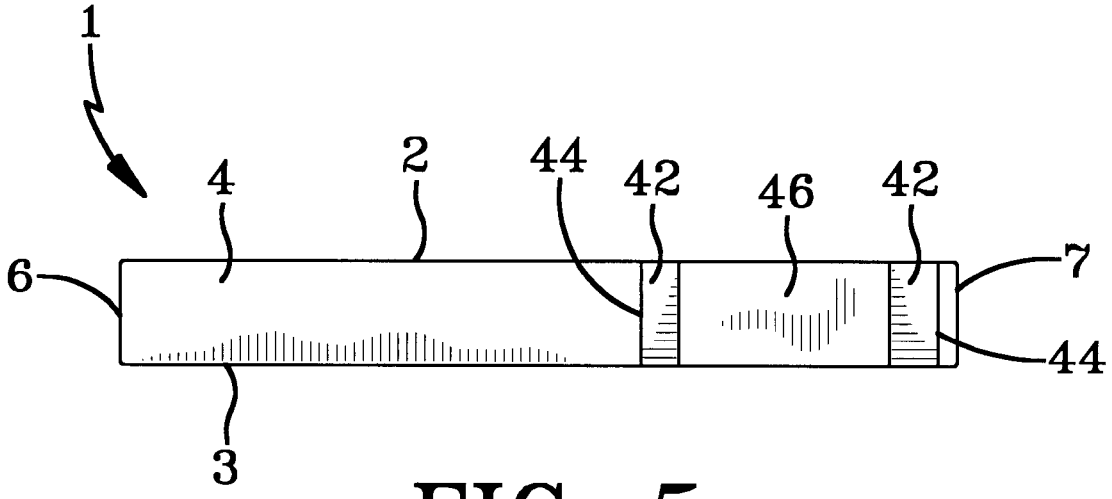
FIG. 5 is a bottom plan view of the embodiment of FIG. 4.

FIG. 4 and FIG. 5 show a third embodiment of the present invention. In this embodiment heel section 7 of the putter head 1 contains a golf ball-receiving cutout 40 having an upper surface 46 and a pair of walls 42. Cutout 40 is positioned so that the lower edges 44 of walls 42 form an opening in the heel section 7 of the putter head 1 and the cutout opens vertically through sole surface 4. In the embodiment of FIG. 4 and FIG. 5, the upper surface 46 of the cutout 40 is in the shape of a flat plane.

A conventional hosel and shaft assembly is attached by conventional means to the top surface 5 of the putter head 1 in a position that will promote solid contact with the "sweet spot" 10 on the front face surface 2 of the putter head 1. The position of the hosel/shaft attachment area 9 is shown in the Figures for illustrative purposes only. The actual position of the attachment area will vary depending on the particular configuration of the putter head 1.

A contour or cavity optionally may be provided in the rear plane 3 of the putter head 1 in order to distribute the weight of the putter head appropriately. Aiming lines or directional guides optionally may be inscribed or inset into the top surface 5 of the putter head 1 to assist the golfer in aligning the putter face 2 for making a putting stroke.

A hanging means, such as a flange or other protrusion, optionally may be provided in the heel portion of top surface 5 to allow the golfer to conveniently hang the putter on the exterior of the golf bag. One type of optional hanging means 50 is illustrated in FIG. 3.

While the present invention has been described in terms of the preferred embodiments, it is recognized that persons skilled in this art will readily perceive many modifications and variations in the embodiments described above. Such modifications and variations are included within the scope of this invention.

I claim:

1. A golf putter head comprising:

a front face surface for striking a golf ball, a rear surface that is approximately parallel to the front face surface, a top surface having a generally rectangular planar profile, and a sole surface, said putter head having a toe section fore and a heel section aft, said putter head having a width between the front face surface and the rear surface that is less than the diameter of a golf ball; and a golf ball receiving cutout in the heel section of the putter head that extends perpendicularly through both the front face surface and the rear surface of the putter head, said cutout having an upper surface and a pair of walls formed by two opposing flat smooth surfaces that terminate in straight, parallel lower edges to form an opening for receiving a golf ball into the cutout, said lower edges being spaced apart at a distance greater than the diameter of a golf ball, said cutout walls being tapered toward each other at their upper edges at an included angle of from about 3 degrees to about 22 degrees to form a self-holding taper for engaging a golf ball, said upper surface connecting the two cutout walls to form a closed end of the cutout, said cutout having an axial height sufficient to allow engagement of a golf ball with the cutout walls without interference from the upper surface of the cutout, said cutout being positioned in the heel section of the putter head so that the cutout opens vertically through the sole of the putter head, or horizontally through the heel of the putter head, or at any angle between the vertical and the horizontal, whereby said putter head may be held by an attached shaft in a substantially vertical position and the opening of said cutout placed over a ball such that the ball is engaged between a single point of contact with each of said tapered cutout walls and may be retrieved from the green or other surface.

2. The putter head of claim 1 wherein the upper surface of the cutout is in the shape of a flat plane.

3. The putter head of claim 1 wherein the upper surface of the cutout is in the shape of a partial cylinder.

4. The putter head of claim 1 wherein the width of the putter head is between about 0.5 inch and about 1.5 inches.

5. The putter head of claim 4 wherein the width of the putter head is between about 0.5 inch and about 1.25 inches.

6. The putter head of claim 5 wherein the width of the putter head is between about 0.5 inch and about 1.0 inch.

7. The putter head of claim 1 wherein the lower edges are spaced apart at a distance sufficient to accommodate the American golf ball, the larger magna golf ball, and the smaller British golf ball.

8. The putter head of claim 1 wherein the cutout is positioned to open vertically through the sole of the putter head.

9. The putter head of claim 1 wherein the cutout is positioned to open horizontally through the heel of the putter head.

10. The putter head of claim 1 wherein the cutout is positioned to open at an angle between the vertical and the horizontal.

11. The putter head of claim 1 wherein the cutout walls are tapered at an included angle of from about 10 degrees to about 16 degrees.

12. The putter head of claim 1 wherein the cutout walls are tapered at an included angle of about 14 degrees.

* * * * *